US005305706A

United States Patent [19]

Arjomand

[11] Patent Number: 5,305,706

[45] Date of Patent: Apr. 26, 1994

[54] PAGE NUMBER INDICATING BOOKMARKER

[76] Inventor: Ataullah Arjomand, P.O. Box 7084, Bellevue, Wash. 98008

[21] Appl. No.: 28,362

[22] Filed: Mar. 9, 1993

[51] Int. Cl.[5] ..... B42D 9/00; G09F 9/40

[52] U.S. Cl. ..... 116/234; 116/321; 116/323

[58] Field of Search ..... 116/225, 234, 235, 236, 116/237, 238, 239, 240, 321, 322, 323, 324; 281/42

[56] References Cited

U.S. PATENT DOCUMENTS

| | | | |
|---|---|---|---|
| 168,395 | 10/1875 | Harris | 116/234 X |
| 711,240 | 10/1902 | Zaring | 116/323 X |
| 1,249,980 | 12/1917 | Mahan | 40/491 |
| 1,501,233 | 7/1924 | Rand | 116/324 X |
| 1,880,089 | 9/1932 | Heidecorn et al. | 116/323 |
| 2,543,182 | 2/1949 | Lang | 116/235 |
| 2,630,777 | 3/1953 | Johnson | 116/235 |
| 2,787,068 | 4/1957 | Anspach | 116/324 X |
| 3,583,358 | 6/1971 | Hanson | 116/235 |
| 4,901,665 | 2/1990 | Carlin | 116/235 |
| 5,101,756 | 4/1992 | Strumbos | 116/234 |

FOREIGN PATENT DOCUMENTS

| | | | |
|---|---|---|---|
| 2222387 | 3/1990 | United Kingdom | 116/234 |

*Primary Examiner*—William A. Cuchlinski, Jr.
*Assistant Examiner*—W. Morris Worth
*Attorney, Agent, or Firm*—Craine & Jackson

[57] ABSTRACT

A page number indicating bookmarker capable of being selectively attached to a planar surface in a book which enables a reader to record a desired page number. The page number indicating bookmarker includes plurality of digit indicators which may be selectively attached in a side-by-side manner to any planar surface in the book. Each digit indicator is manipulated to record one digit of the desired page number. Each digit indicator includes an elongated body with a set of digits 0 to 9 aligned longitudinally on the top surface thereof. A collar with a central cutout is attached to the elongated body which slides over the elongated body. The central cutout enables the user to view a digit printed on the top surfaced of the elongated body disposed directly below the collar. In another embodiment of the invention, a plurality of digit indicators are used in combination with one topic indicator which enables a user to record the page number of important topics or subjects found in the book.

12 Claims, 2 Drawing Sheets

PAGE NUMBER INDICATING BOOKMARKER

BACKGROUND OF THE INVENTION

1. Field of the Invention

This invention relates to bookmarkers or devices used to signal or indicate a desired page in a book and, more particularly, to such bookmarkers or devices capable of being temporarily fixed at a convenient location in the book.

2. Description of the Related Art

Bookmarkers have been used for several hundred years to signal or mark a desired page in a book. Typically, such bookmarkers are placed between the pages of a book so that a portion of the bookmarker extends over the top edge of the pages. When the book is closed, the extending portion of the bookmarker is visible so that the user may easily locate and open the book to the desired page.

There are several known problems with typical bookmarkers. One common problem is that during use, the bookmarker can be accidently removed from the book. Another problem is that the bookmarker can be easily displaced when disposed between the pages so that a portion of the bookmarker is no longer visible when the book is closed.

Another problem is that the bookmarker may physically damage the adjacent pages of the book. For example, bookmarkers having a clip which enables the bookmarker to be attached to one edge of the page, may permanently bend or damage the page. Also, bookmarkers having an adhesive layer which allow the bookmarker to be temporarily attached to the surface of the page, may leave an adhesive residue on the page when the bookmarker is removed which may cause the adjacent pages to stick together. Also, ink from the bookmarker itself may "bleed" onto the surfaces of the pages.

One desirable feature not presently found with typical bookmarkers, is a means to enable an individual to indicate an important topic or subject presented on a desired page.

A bookmarker that solves these and other problems identified further herein, would be very desirable.

SUMMARY OF THE INVENTION

It is an object of the present invention to provide a page number indicating bookmarker capable of recording any desired page number in a book.

It is another object of the present invention to provide such a page number indicating bookmarker that may be selectively and temporarily attached to a page or other planar surface of the book.

It is a further object of the present invention to provide such a page number indicating bookmarker that can be used to record the page number of an important item or topic, such as a graph, chart, footnote, in the book.

It is another object of the present invention to provide such a page number indicating bookmarker that is relatively inexpensive to manufacture.

These and other objects are met by providing an attachable page number indicating bookmarker capable of being selectively attached to a page or other planar surface in a book. The page number indicating bookmarker includes a plurality of digit indicators which are used together to indicate a desired page number in a book. Each digit indicator includes an "I-shaped elongated body with a set of digits 0 through 9 aligned longitudinally and printed on the top surface thereof. A collar is attached to the vertically aligned central region of the elongated body and is able to slide thereover in a direction parallel to the body's longitudinal axis. The collar has viewing means which enables one digit printed on the top surface of the elongated body directly below the collar to be viewed from above. By selectively moving the collar over the elongated body, the user is able to select and display one digit on the digit indicator In one embodiment, the viewing means includes a central cutout manufactured on the top surface of the collar.

In the preferred embodiment, three digit indicators are aligned and attached in a side-by-side manner to the page or other planar surface in the book. By moving the three collars on the three digit indicators so that the corresponding digits on the page number are indicated, the user is able to record a page number between 000 and 999.

An attachment means, such as a suitable adhesive, is attached to the bottom surface of the elongated body which enables the user to temporarily attached the digit indicator to the page or planar surface. Generally, the digit indicators are attached in a convenient location in the book, such as the inside surface of the front or rear book cover, so that the user does not have to search for them later.

In another embodiment, the page number indicating bookmarker includes a plurality of digit indicators and at least one topic indicator. The topic indicator has a structure similar to the digit indicator described above except with a plurality of topics or subject titles printed on the top surface of its elongated body replacing the 0–9 digits. By using a topic indicator along with a plurality of digit indicators, the user can record a desired topic and page number in the book.

In the preferred embodiment, the digit and topic indicators are manufactured in a single sheet structure with perforating lines manufactured between the digit and topic indicators. During use, the user is able to easily remove one or more digit or topic indicators from the sheet structure.

DESCRIPTION OF THE PREFERRED EMBODIMENT(S)

Figure 1:
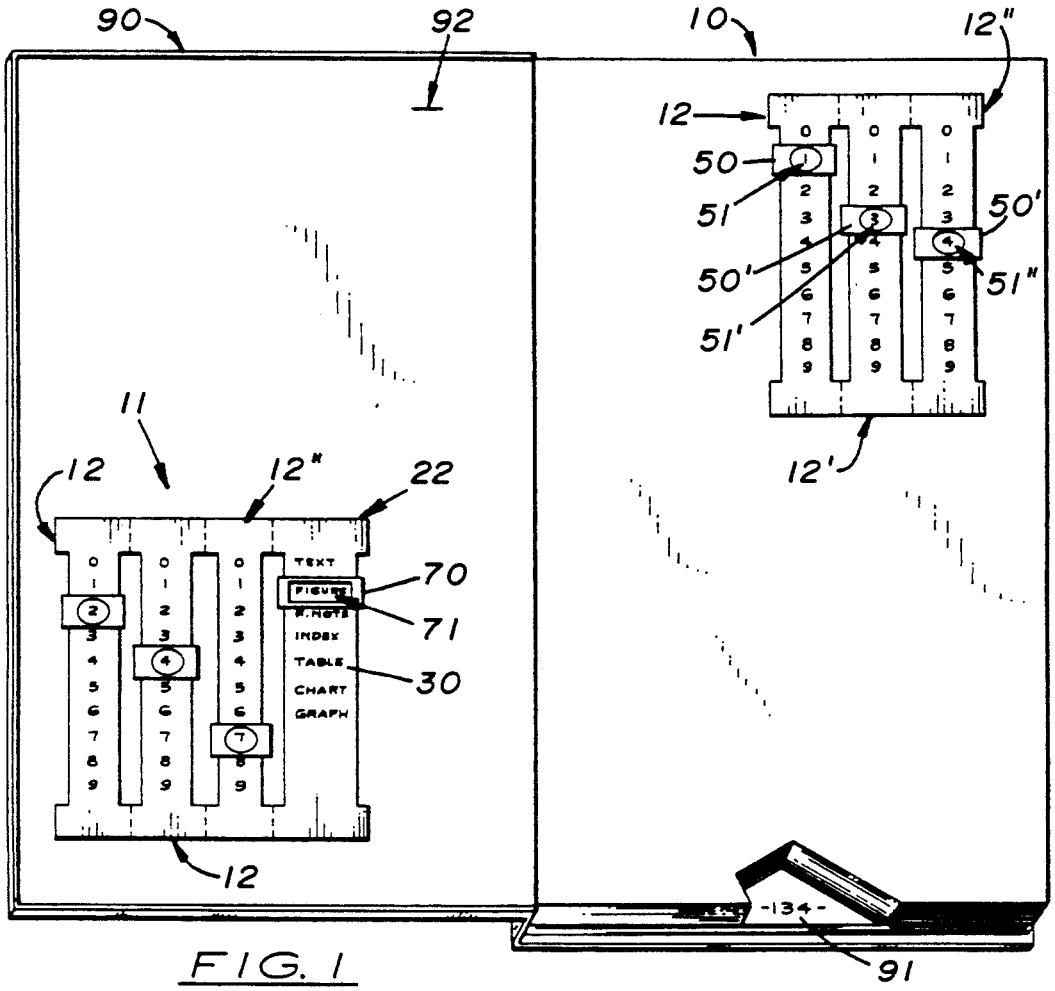
FIG. 1 is a plan view of a book with two embodiments of the page number indicating bookmarkers attached to a planar surface inside the front cover of the book.

These and other objects are met by providing an attachable page number indicating bookmarker, generally referred as 10, capable of being selectively attached to any planar surface in a book 90, such as the inside surface of the front or rear book cover 92.

In FIGS. 1-5, a first embodiment of the page number indicating bookmarker 10 is shown which includes a plurality of digit indicators 12, 12' and 12" attached in a side-by-side manner on the planar surface. Each digit indicator 12 is "I" shaped and comprises a vertically aligned elongated body 13. The elongated body 3 has a vertically aligned central region 17 and two integrally formed, horizontally aligned, top and bottom stop members 18 and 19, respectively. A set of digits 0 through 9, generally referred as 20, are aligned along the longitudinal axis 14 of the elongated body 13 and printed on the top surface 15 thereof.

Figure 2:
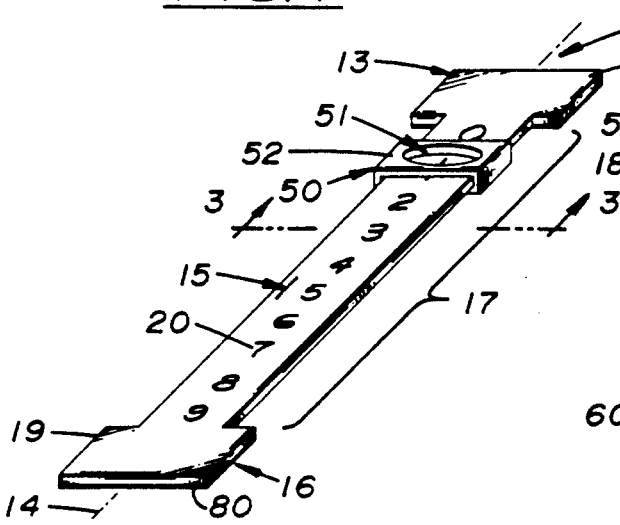
FIG. 2 is a perspective view of a digit indicator disclosed herein.
Figure 3:
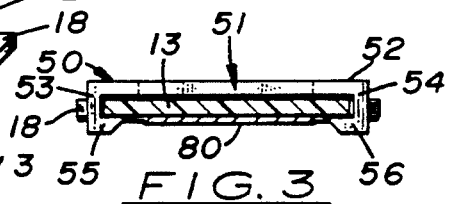
FIG. 3 is a sectional end view of the digit indicator taken along line 3—3 shown in FIG. 2.

As shown in FIGS. 2 and 3, a collar 50 is attached to the elongated body 13 which is able to slide over the central region 17 of the elongated body 13 in a direction parallel to the longitudinal axis 14. The collar 50 has a top horizontal surface 52 and left and right vertical arms 53 and 54, respectively, which extend downward over the sides of the central region 17. The distal ends of the vertical arms 53 and 54 are bent inwardly to form gripping feet 55 and 56, respectively, which act to hold the collar 50 in a selected position on the elongated body 13.

Manufactured centrally on the top surface 52 of the collar 50 is a viewing means which enables a digit 20 printed on the top surface 15 of the central region 17 located directly below the collar 50 to be viewed from above. As shown in FIGS. 1-3, in the preferred embodiment the viewing means comprise an oval (shown), circular, square, or rectangular-shaped cutout 51 having sufficient size and shape so that one digit 20 may be seen. By moving the collar 50 vertically along the central region 17 of the elongated body 13, the user is able to selectively display different digits 20.

Figure 4:
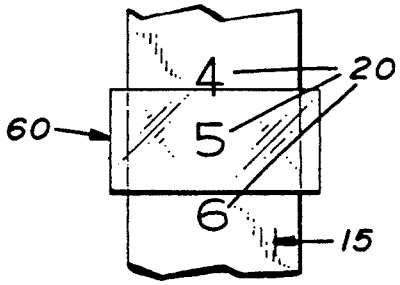
FIG. 4 is a plan view of another embodiment of the transparent collar.

In FIG. 4, and alternative embodiment of the collar 60, is shown, made of transparent material which enables a digit 20 printed on the top surface 15 to be seen therethrough. To further distinguish the selected digit 20 from the other digits 20, collar 60 may be tinted a contrasting color.

Figure 5:
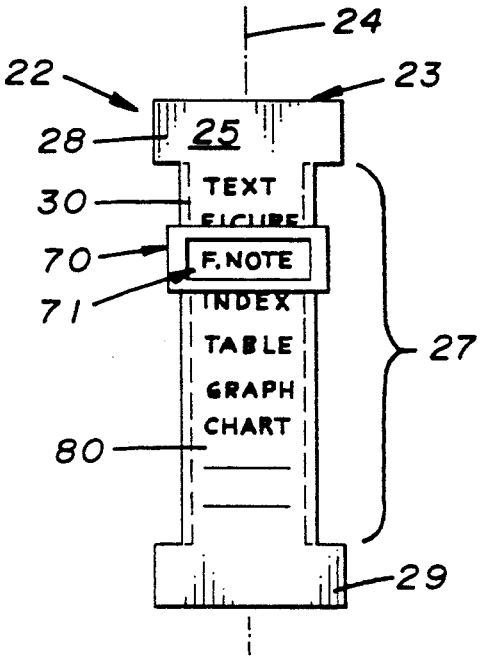
FIG. 5 is a plan view of the topic indicator disclosed herein.

As seen more clearly in FIGS. 2 and 3, an attachment means, such as a suitable adhesive 80, is attached to the bottom surface 16 of the elongated body 13 which enables the digit indicator 12 to be temporarily attached to a planar surface In the preferred embodiment, the adhesive 80 is applied only to the bottom surface 16 below the top and bottom stop members 18 and 19, respectively. For additional adhesion, the adhesive 80 may also be applied to the bottom surface 16 of the entire central region 17. As shown in FIG. 5, when applied in this manner, the outer edge of the bottom surface 16 of the central region 17 is clear of adhesive 80 so that the collar 70 may slide freely over the central region 17. It should be understood, however, that other attachment means for temporarily attaching the elongated body 13 to the planar surface may be used with the invention, such as a clip structure, not shown.

In FIGS. 1 and 5, a second embodiment of the page number indicating bookmarker, referred as 11, is shown comprising a plurality of digit indicators 12 described and one topic indicator 22. Each topic indicator 22 is "I" shaped and includes a vertically aligned second elongated body 23 with a central region 27 with integrally formed, horizontally aligned, top and bottom stop members 28 and 29, respectively. The central region 27 of the elongated body is slightly wider than the elongated body 13 used with the digit indicator 12 so that a plurality of title topics 30 describing items commonly found in the book 90, such as titles, figures, charts, graphs or other items, may be longitudinally aligned and printed on the top surface 25. A second collar 70, which has a structure similar and functions in the same manner as the collar 50 used with the digit indicator 12, is attached to the second elongated body 23 and slides over the central region 27 in a direction parallel to the longitudinal axis 24. By moving the second collar 70 vertically over the second elongated body 23, the user is able to select and indicate one desired topic title 30 printed on the top surface 25.

The elongated bodies 13 and 23 are made of thin plastic material approximately 0.010 inch thick. The digit indicator 12 and topic indicator 22 measure approximately 3 inches in height and ½ to ¾ inches in width. The collars 50, 60 and 70 are made of similar thin plastic material and measure approximately ½ inch in height and ½ to ¾ inches in width.

Figure 6:
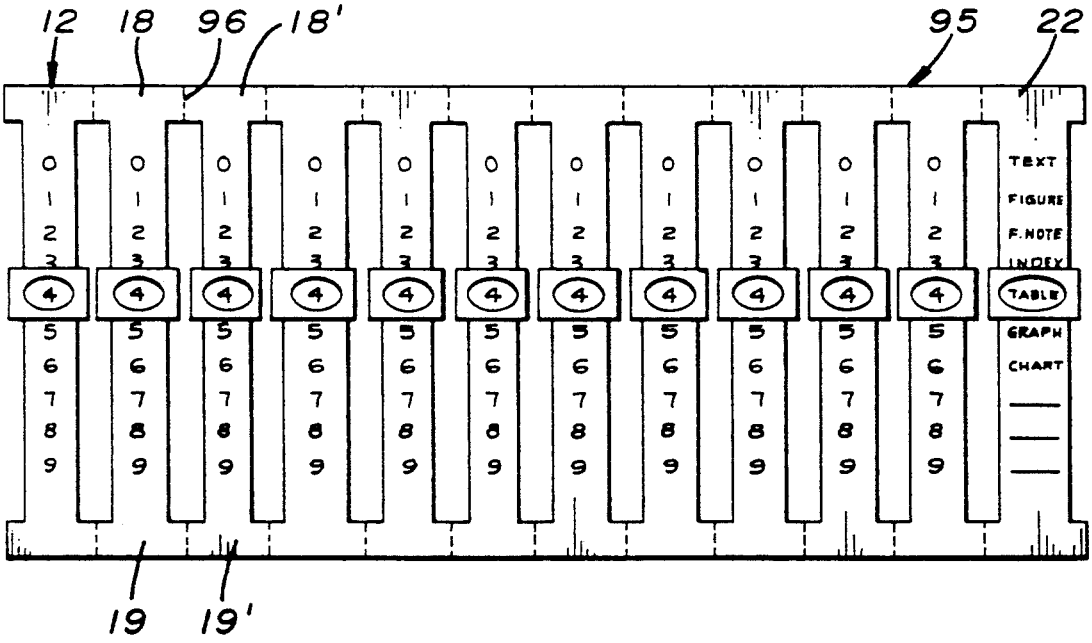
FIG. 6 is a sheet structure having a plurality of digit indicators and a topic indicator manufactured thereon.

As shown in FIG. 6, the digit indicators 12 and topic indicators 22 are manufactured in a sheet structure 95. The sheet structure may have a plurality of digit indicators 12 formed therein which are separated by perforating lines 96 between their adjoining top and bottom stop members 18, 18', and 19, 19', respectively. By tearing the sheet structure 95 along the perforated lines 96, the user is able to remove either a single digit indicator 12 or a group of digit indicators 12 from the sheet structure 95. During manufacturing, a suitable adhesive (not shown) is applied to the bottom surface of the sheet structure directly below the top and bottom stop members 18, 19, respectively.

The topic indicator 22 may be formed in the same sheet structure 95 having a plurality of digit indicators 12 or a separate sheet structure (not shown) having a plurality of topic indicators 22.

Since most books 90 have between 000 and 999 pages, a set of three digit indicators 12, 12' , and 12" are removed from the sheet structure 95 and adhesively attached in a side-by-side manner to the inside surface of the front or rear cover 92 of the book 90. When the user wants to record a desired page number 91 in the book 90, (page number "134" shown), the collar 50 located on left digit indicator 12 is moved vertically over the central region and aligned over the digit "1" printed. The digit "1" can then be seen through the cutout 51 of the collar 50. This process is repeated on the middle and right digit indicators 12' and 12" for the second digit "3" and the third digit "4" , respectively. When the user wants to record a new page number 91, the collars 50, 50' and 50" on the left, middle, and right digit indicators 12, 12', 12" are moved so that the correct digits making up the new page number 91 are indicated. When the user wants to record the location of an important item in the book, either the second embodiment 11 of the page number indicator bookmarker is attached to the planar surface or the original page number indicating bookmarker 10 is converted into the second embodiment 11. To convert the first embodiment 10 into the second embodiment 11, the user attaches a topic indicator 22 adjacent to an outer digit indicator 12 or 12".

Generally during use, the page number indicating bookmarkers 10 or 11 are attached at one convenient location in the book 90, such as the inside surface of the front or rear cover 92. With continuous use, the user learns to automatically find the page number indicating bookmarkers 10 or 11, behind the front cover 92. When the user is done with the book 90, the page number indicating bookmarkers 10 or 11 may be left in the book 90 or removed and used in another book.

In compliance with the statute, the invention has been described in language more or less specific as to structural features. It should be understood, however, that the invention is not limited to the specific features shown since the means and construction shown comprises the preferred forms of putting the invention into effect. The invention is, therefore, claimed in any of its forms or modifications within the legitimate and valid scope of the amended claims, appropriately interpreted in accordance with the doctrine of equivalents,

I claim:

1. An attachable page number indicator bookmarker, comprising a sheet perforated to form a plurality of detachable digit indicators each being selectively attachable in a side-by-side manner on a planar surface in a book adjacent to another said digit indicator and used together to indicate a desired page number therein, each said digit indicator including:

(a) an I-shaped elongated body, said elongated body having a central region, a top surface, a bottom surface, and a longitudinal axis;

(b) a set of ten digits 0 to 9 aligned longitudinally on said top surface of said central region of said elongated body;

(c) a collar and means for slidingly attaching said collar over said top surface of said elongated body, said collar being slidable over said central region in a direction parallel to said longitudinal axis, said collar having a viewing means which enables one said digit printed on said top surface of said elongated body directly below said collar to be viewed from above, and;

(d) an adhesive applied to said bottom surface of said elongated body which enables said digit indicator to be selectively attached to said planar surface of said book.

2. A page number indicating bookmarker, as recited in claim 1, wherein said viewing means comprises a central cutout on said collar.

3. A page number indicating bookmarker, as recited in claim 1, wherein said viewing means comprises said collar being made of transparent material.

4. A page number indicating bookmarker, as recited in claim 3, wherein said transparent material is tinted a contrasting color.

5. A page number indicating bookmarker, as recited in claim 1, wherein three digit indicators are aligned in a side-by-side manner on said planar surface.

6. An attachable page number indicator bookmarker, comprising:

a. a plurality of digit indicators capable of being selectively attached in a side-by-side manner on a planar surface of a book and used to indicate a desired page number located therein, each said digit indicator including:

an I-shaped elongated body, said elongated body having a central region, a top surface, a bottom surface, and a longitudinal axis;

a set of ten digits 0 to 9 aligned longitudinally on said top surface of said central region of said elongated body;

a sliding collar attached over said top surface of said elongated body, said collar being capable of sliding over said central region in a direction parallel to said longitudinal axis, said collar having a viewing means which enables one said digit printed on said top surface of said elongated body directly below said collar to be viewed from above;

an attachment means attached to said elongated body which enables said digit indicator to be selectively attached to said planar surface of said book, and;

b. a topic indicator aligned adjacent to an outer said digit indicator, said topic indicator including;

a second I-shaped elongated body having a central region, a top surface, a bottom surface, and a longitudinal axis;

a set of topics titles printed on said top surface of said second elongated body, said set of topics titls being aligned longitudinally on said central region of said elongated body;

a sliding second collar attached to said second elongated body, said second collar being capable of sliding on said second elongated body in a direction parallel to said longitudinal axis, said second collar having a viewing means which enables one said topic title printed on said top surface of said second elongated body and located directly below said second collar to be viewed from above, and;

an attachment means attached to said second elongated body which enables said topic indicator to be selectively attached to said planar surface of said book.

7. A page number indicating bookmarker, as recited in claim 6, wherein said attachment means on said topic indicator is an adhesive on said bottom surface of second elongated body.

8. A page number indicating bookmarker, as recited in claim 7, wherein said viewing means on said second collar comprises a central cutout.

9. A page number indicating bookmarker, as recited in claim 8, wherein said viewing means comprises said second collar being made of transparent material.

10. A page number indicating bookmarker, as recited in claim 9, wherein said transparent material is tinted.

11. An attachable page number indicating bookmarker, comprising:

a. three digit indicator attached in a side-by-side manner on a planar surface in a book and used to indicate a desired page number therein, each said digit indicator including:

an "I-shaped" elongated body having a central region, top surface, a bottom surface, and a longitudinal axis;

a set of digits 0 to 9 printed on said top surface of said elongated body, said set of digits being aligned on said top surface parallel to said longitudinal axis of said elongated body;

a collar slidingly attached to said elongated body, said collar being capable of sliding over said central region of said elongated body in a direction parallel to said longitudinal axis, said collar having a viewing means which enables one said digit printed on said top surface of said elongated body and located directly below said collar to be viewed from above;

an adhesive applied to said bottom surface of said elongated body which enables said page number indicating bookmarker to be selectively attached to said planar surface of said book, and;

b. a topic indicator aligned in a side-by-side manner to an outer said digit indicator, said topic indicator including a second elongated body having a top surface, a bottom surface, and a longitudinal axis, a set of topic titles printed on said top surface of said second elongated body, said set of topic titles being aligned on said top surface parallel to said longitudinal axis of said elongated body;

a second collar slidingly engaged to said second elongated body, said second collar being capable of sliding on said second elongated body in a direction parallel to said longitudinal axis, said second collar having a viewing means which enables one said topic title printed on said top surface of said second elongated body and located directly below said second collar to be viewed from above, and;

an attachment means attached to said second elongated body which enables said topic indicator to be selectively attached to said planar surface of said book.

12. A sheet of page number indicating bookmarkers, comprising a plurality of I-shaped digit indicators manufactured thereon, each said digit indicator having an elongated body with a vertically aligned central region, said central region having a top surface with a set of digits 0–9 printed thereon, each said digit indicator having a sliding collar capable of moving vertically over said central region, said collar having a viewing means with enables a digit located below said collar to be seen from above, each said digit indicator being separated by perforated lines which enables a user to selectively remove one or a group of digit indicators from said sheet, said sheet having a bottom surface with a suitable adhesive applied thereto which enables each said digit indicator to be applied to a planar surface.

* * * * *